United States Patent [19]

Schwegler

[11] 4,154,142

[45] May 15, 1979

[54] EXTERNALLY POWERED CARRIER

[75] Inventor: Roy F. Schwegler, Rock Island, Ill.

[73] Assignee: The United States of America as represented by the Secretary of the Army, Washington, D.C.

[21] Appl. No.: 831,012

[22] Filed: Sep. 6, 1977

[51] Int. Cl.[2] ..... F41F 11/00; F41D 7/02

[52] U.S. Cl. ..... 89/11; 89/185

[58] Field of Search ..... 89/11, 185 R, 187 R, 89/172, 173

[56] References Cited

U.S. PATENT DOCUMENTS

| | | | |
|---|---|---|---|
| 475,276 | 5/1892 | Garland | 89/11 |
| 1,285,765 | 11/1918 | Martin | 89/11 |
| 1,290,842 | 1/1919 | Mottin | 89/11 |
| 2,077,415 | 4/1937 | House | 89/187 |
| 3,648,561 | 3/1972 | Stoner | 89/187 X |

FOREIGN PATENT DOCUMENTS

| | | | |
|---|---|---|---|
| 835417 | 9/1938 | France | 89/11 |

OTHER PUBLICATIONS

"Armor Machine Gun Review", General Electric, Oct. 28 and 29, 1970.

"The Chain Gun for the AAH Design-to-Cost Action", *National Defense,* vol. LVIII, No. 322, pp. 351-354, Jan. 1974.

"Introducing the Chain Gun", International Defense Review, pp. 179 and 271-274, Apr. 1977, vol. 10, No. 2.

*Primary Examiner*—David H. Brown

*Attorney, Agent, or Firm*—Nathan Edelberg; Robert O. Richardson

[57] ABSTRACT

An externally powered carrier for an automatic weapon wherein rotary movement of an electric motor is translated into fore and aft movement of the carrier by means of an eccentrically positioned motor driven pin moving laterally in a transverse carrier cam track.

9 Claims, 6 Drawing Figures

12
14
16
10
1
I
30
34
32
26
28
18
20
24
22

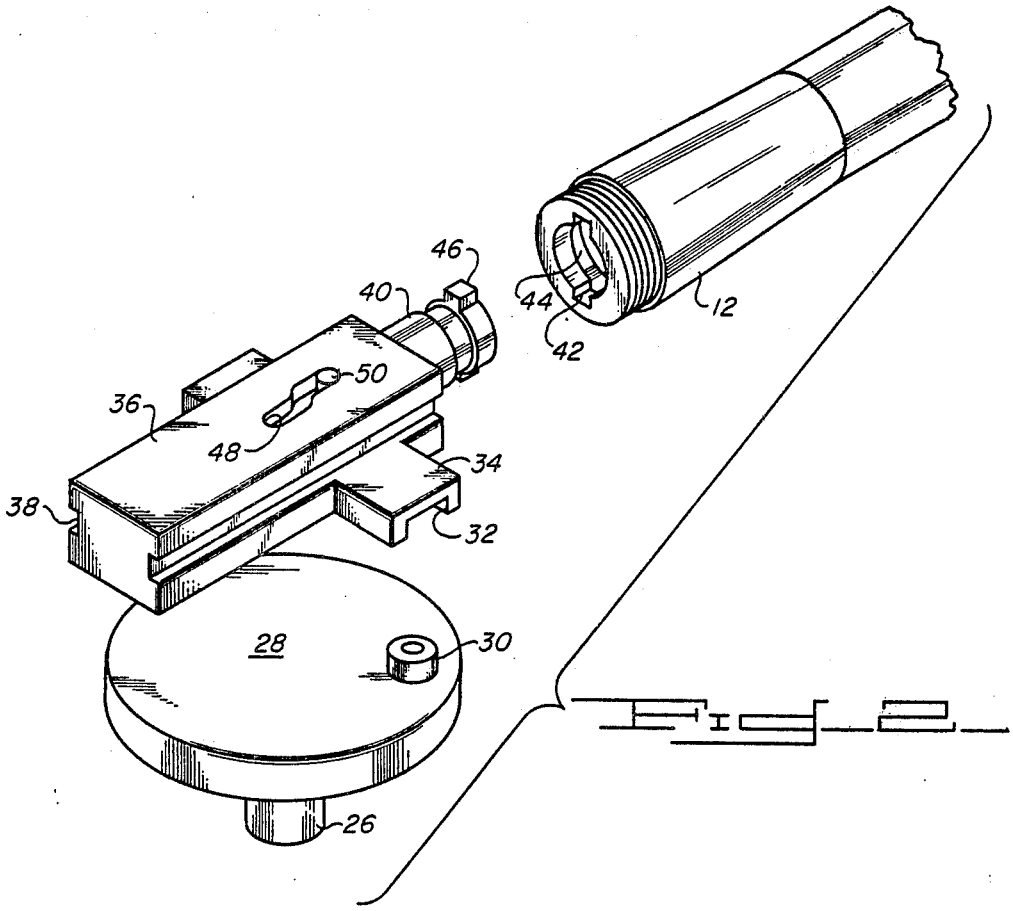
FIG. 2
FIG. 3
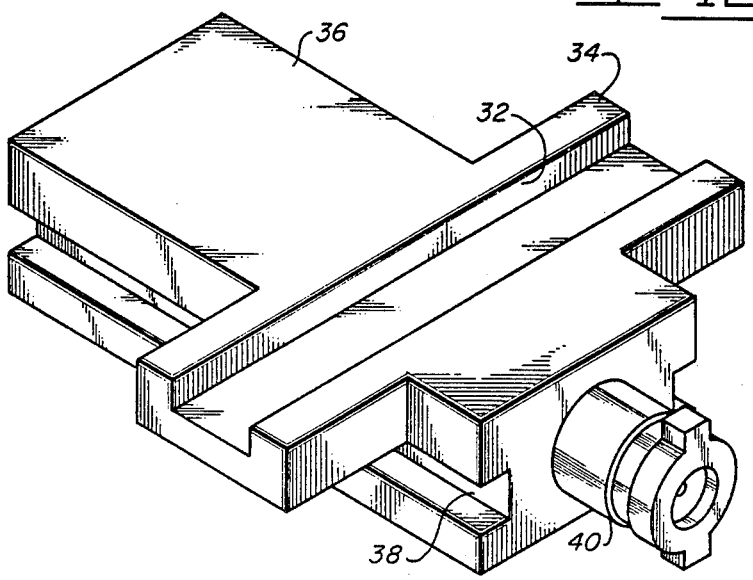

EXTERNALLY POWERED CARRIER

GOVERNMENT RIGHTS

The invention described herein may be manufactured and/or used by or for the Government for governmental purposes without the payment of any royalty thereon.

BACKGROUND OF THE INVENTION

For years machine guns have been actuated by various mechanisms which utilize external power sources. The power source is usually an electric motor, which, through these mechanisms, performs basic weapon functions such as loading, locking, firing, extraction and advancement of the ammunition. One of the most common mechanisms of this type is that which is used in the mini-gun. This is a multiple barrel weapon, each barrel having its own separate bolt. The barrels and bolts rotate, which causes reciprocation of the bolts by engagement of a follower, on each bolt, with a serpentine cam track within the receiver. Another design utilizes a helical cam track in a rotating cylindrical drum to reciprocate the bolt. Still another design utilizes a crank with a connecting rod attached to the bolt. The most recent design uses a chain carried on four sprockets in a substantially rectangular path. The chain carries a pin which engages a slot on the bolt carrier and causes reciprocation of the bolt.

All of the above drive methods tend to be quite complicated. Most of them require expensive machining of difficult cam surfaces or achieve reliability through the use of expensive components.

SUMMARY OF THE PRESENT INVENTION

The present invention eliminates expensive machining by utilizing a straight cam track on the bolt carrier. The cam track on the bolt carrier is engaged by a roller, on an eccentrically positioned pin. This pin is carried by a crank disk which is rotated by appropriate gearing to an electric motor. This arrangement is commonly referred to as the Scotch yoke mechanism and may be easily adapted to reciprocate the bolt and carrier of rotary locking bolt weapons. The bolt, in this type of weapon, mates with the breech end of the barrel and rotates several degrees in order to lock the bolt and barrel together. The rotation of the bolt may be accomplished by means of a pin on the bolt which engages an elementary cam slot in the bolt carrier. Continued longitudinal movement of the carrier after the bolt engages the barrel causes the desired bolt rotation. The bolt is locked as the carrier moves toward the barrel and unlocked as the carrier is retracted.

The Scotch yoke mechanism may also be used to power weapons which do not utilize a rotary locking bolt. A slight modification of the cam track on the bolt carrier is required when the bolt does not rotate to lock. The cam track would incorporate a curved section between straight sections at both ends. The radius of the curved section would be equal to the radius of the path traveled by the eccentrically positioned pin. This would allow a brief dwell period while the bolt was in battery. It is during this dwell period that the weapon is fired and peak chamber pressure is experienced. Generally some type of bolt locking mechanism is required to keep the bolt in battery. The eccentric pin would otherwise receive the firing load, requiring the pin and roller to be of a heavy mass which would unbalance the crank disk and cause vibration. This firing load on the pin would also affect the rotational velocity of the crank disk. A bolt locking lug may be easily incorporated into this mechanism to absorb the firing load instead of the eccentric pin and roller. A cam slot cut around the circumference of the crank disk would raise and lower the lug to lock and unlock the bolt.

The Scotch yoke arrangement also lends itself to simplified firing mechanisms. One arrangement utilizes an elongated triangular shaped accelerator. The accelerator is pivoted at one corner of the short side. The other corner of the short side extends into the path traveled by the eccentric pin. The elongated third corner extends to the base of the firing pin. As the disk rotates, the roller on the eccentric pin strikes the accelerator. The accelerator pivots sharply against the firing pin which then detonates the round. The firing pin is returned to its original position by a helical spring. In this system the velocity of the firing pin is directly proportional to the angular velocity of the crank disk. Therefore, reliability is decreased as the firing rate decreases. A more reliable but slightly more complex system incorporates a striker type firing pin. A helical spring is used to impart energy to the firing pin in this system. Firing pin velocity is therefore constant and reliable firing is achieved even at low firing rates.

BRIEF DESCRIPTION OF DRAWINGS

FIG. 2 is an exploded view, in perspective, of the crank disk, carrier, bolt and barrel, FIG. 3 is a perspective view of the bottom side of the bolt carrier showing the cam track.

DETAILED DESCRIPTION OF ILLUSTRATIVE EMBODIMENTS

Figure 1:
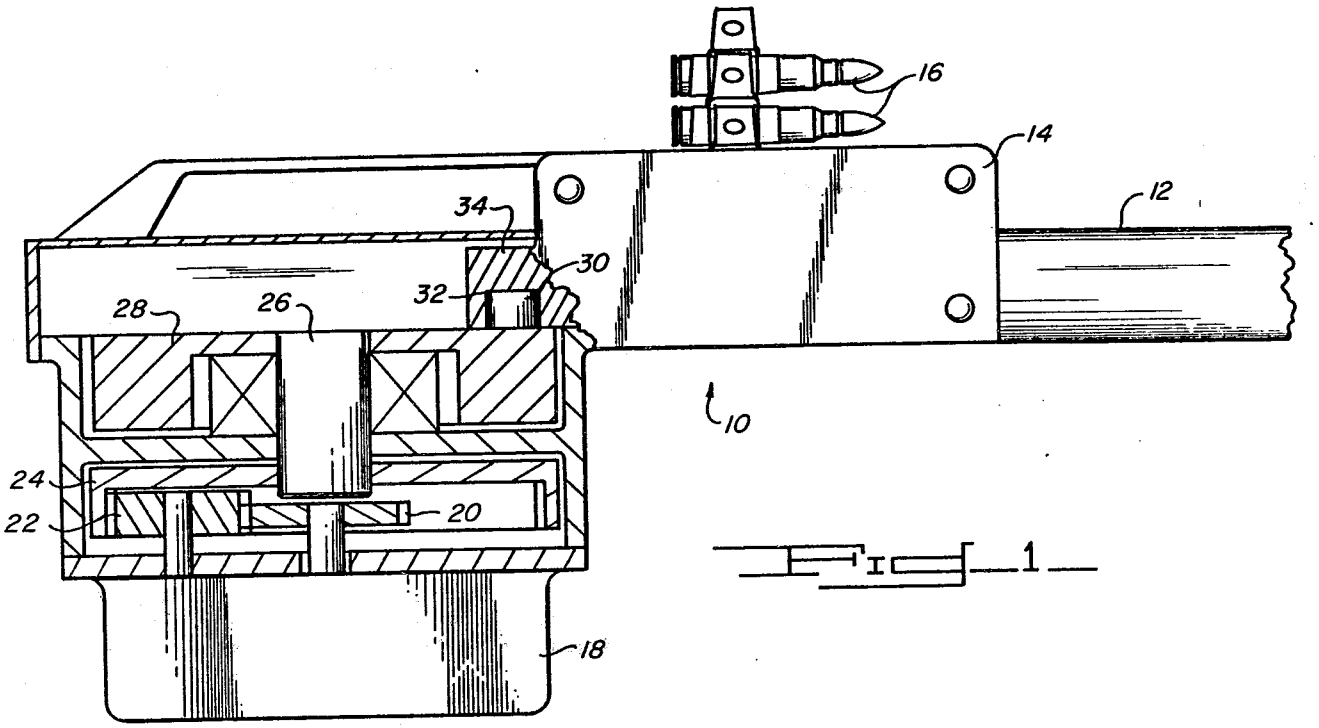
FIG. 1 is an elevational view, partly in section, showing the assembled parts of the drive mechanism.

Referring now to FIG. 1 there is shown in elevation an externally powered weapon 10 including a gun barrel 12, feed tray 14 for receiving and chambering linked rounds 16, and an electric motor 18. This motor is geared through a first gear 20, reduction gear 22, and drive gear 24, for rotating crank shaft 26. This shaft rotates a crank disk 28 which has a roller 30 mounted eccentrically thereon. This roller rides within a transverse cam track 32 within a carrier translator 34 which is part of the carrier mechanism of the gun. The carrier mechanism contains the bolt, firing pin and other structure for chambering the rounds of ammunition and firing the weapon when in a forward or chambered position and extracts spent rounds as it moves rearwardly to recoil position, all in the usual conventional manner well known in the art.

Reference is now made to the exploded view in FIG. 2 to show the relationship and operation of the crank disk 28, carrier 36 with its integral carrier translator 34, and barrel 12. Crank disk 28 is mounted on shaft 26 and spaced from its axis of rotation is the eccentrically positioned roller 30. As the crank disk rotates, the roller 30 travels circumferentially about the shaft 26. Carrier 36 has spaced longitudinal slots 38 in order that the carrier 36 may fit into and move longitudinally in the gun receiver, not shown. Integral with carrier 36 is the carrier translator 34 having transverse cam track 32 within which is positioned the roller 30. Thus, while the roller 30 is traveling in a circumferential path about the axis of shaft 26, it causes fore and aft movement of the carrier as the roller moves transversally in the cam track 32.

The locking structure for the bolt in chamber position is conventional and known in the art. The bolt is locked as the carrier moves forward toward the barrel and unlocked as the carrier is retracted. Here bolt 40 is adapted to move longitudinally relative to the carrier 36. The gun barrel 12 has lug receiving slots 42 and a locking recess 44 wherein the bolt locking lugs 46 on bolt 40 may pass through the slots 42 and rotate within the locking recess 44. This locks the bolt in chamber position and thus absorbs the recoil forces when the ammunition is expended. The relative movement between the bolt 40 and the carrier 36 is accomplished by means of a cam locking channel 48 on the carrier and the interengaging pin 50 on the bolt. In the chambering of the bolt 40, the bolt locking lugs 46 are in the locking recess 44 and continued movement forward of the carrier 36 causes the pin 50 to follow the curved or cam surfaces of locking channel 48. This imparts a rotation to the bolt locking lugs 46. Also when the carrier moves rearwardly the locking pin 50 again follows the cam surfaces of the locking channel 48 to rotate bolt 40 to its unlocked position whereby the bolt locking lugs 46 may pass through the lug receiving slots 42 in the rearward disengaging movement.

In FIG. 3 the carrier 36 is shown in perspective from the bottom. Thus the integral carrier translator 34 with the cam track 32 is visible. This is the cam track within which the roller 30 on the crank disk 28 moves laterally while at the same time moving the carrier 36 longitudinally. In contrast to the species shown in FIGS. 5 and 6 the cam track 32 in FIG. 3 has straight surfaces. The track is straight when used with a carrier having the self-locking and unlocking bolt.

Figure 4:
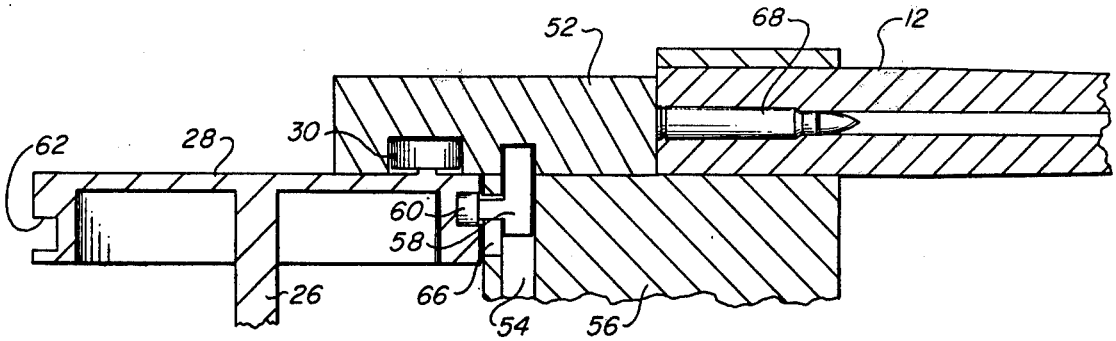
FIG. 4 is an elevational view, in section, showing the recoil absorbing locking lug for use with an integral bolt and carrier.

The embodiment shown in FIG. 4 utilizes an integral carrier and bolt 52 wherein there is no longitudinal relative movement between the carrier and bolt to provide the locking feature shown in FIG. 2. In this embodiment in FIG. 4 the crank disk 28 is positioned on shaft 26 and the eccentrically positioned roller 30 is positioned on the crank disk 28 spaced from the axis of the shaft 26, all in a manner similar to that shown in FIG. 2. However, in the species shown in FIG. 4 there is a vertical channel 54 and slot 66 in receiver 56 to permit the vertical movement of a locking lug 58. This locking lug has connected to it a roller 60 which moves in a cam slot 62 on the crank disk 28 as the disk rotates. This cam slot has a vertical spiral whereby the cam slot directly in front of roller 30 is positioned higher vertically than at its diametric extreme at the rear, as shown in FIG. 4. Thus when roller 30 is rotated by disk 28 to its forward position, to chamber the integral carrier and bolt 52, the roller 60 in cam slot 62 causes the locking lug 58 to move upwardly into a recess 64 in the carrier and bolt 52. The locking lug 58 as it engages the recess 64 of the integral carrier and bolt 52 thus absorbs the recoil forces when cartridge 68 is expended. This locking lug absorbs the recoil forces and thus avoids such pressures to be applied against roller 30. As the crank disk 28 continues to rotate, the spiraled cam slot 62 causes the locking lug 58 to move downwardly out of engagement with recess 54 and, at the same time, roller 30 continues its rotation about the shaft 26. This rotation withdraws the integral carrier and bolt 52 rearwardly for cartridge ejection and subsequent rechambering of a fresh round.

Figure 5:
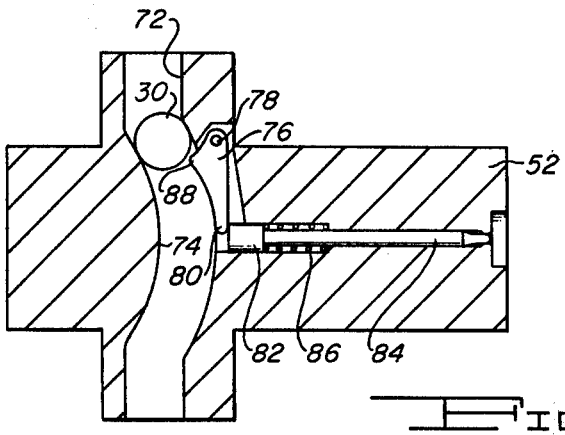
FIG. 5 is a plan view, in section, showing one form of firing mechanism.
Figure 6:
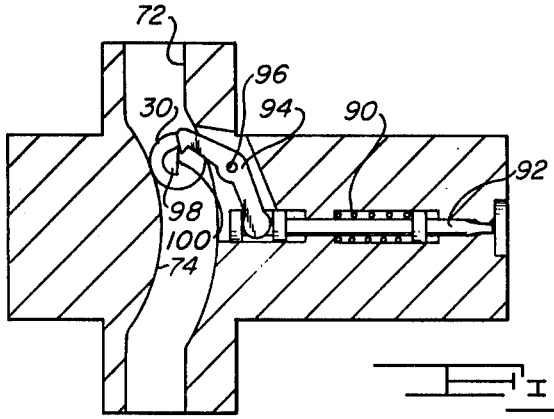
FIG. 6 is a plan view, similar to FIG. 5, showing another form of firing mechanism.

The firing pin mechanisms in FIGS. 5 and 6 may be used either with the locking structure of FIG. 2 or with the locking structure of FIG. 4. The firing pin structure of either FIGS. 5 or 6 will operate with a straight cam track of the type shown in FIG. 3 as well as with the arcuate track shown. The arcuate cam tracks in FIGS. 5 and 6 are for use with integral carrier and bolt structure that do not have the automatic locking feature shown in FIG. 2.

Referring now to FIG. 5 there is shown the carrier 52 having a transverse cam track 72 with an arcuate portion 74 of the same curvature as the path traveled by roller 30. Thus during this engagement of roller 30 with the arcuate portion 74 of track 72 there is no longitudinal movement of carrier 52. This arcuate path version permits integral carrier and bolt 52 to remain motionless in a longitudinal direction while the locking lug 58 in FIG. 4 is in position in recess 64. A triangular shaped accelerator 76 is pivotally mounted at 78 to the integral carrier and bolt 52. The elongated portion 80 engages the base end 82 of firing pin 84. Helical spring 86 urges the firing pin rearwardly to its original position. A cam surface 88 on the accelerator 76 is engaged by roller 30 as it moves through the arcuate portion 74 of the cam track 72. This drives the firing pin forwardly in a manner proportional to the velocity of the externally driving motor, and hence the velocity of roller 30 as it passes through the arcuate portion 74 of the cam track 72.

The firing mechanism shown in FIG. 6 is independent of the velocity of the driving motor and is dependent upon the force of the firing spring 90 which urges the firing pin 92 forwardly. This firing pin is of the striker type. In this version a rocker arm 94 is pivotally mounted at 96 to the integral carrier and bolt 52. In this embodiment the roller 30 passes along cam track 72 and the arcuate portion 74 in the manner similar to that of FIG. 5. However, in the embodiment shown in FIG. 6 there is a pin 98 extending upwardly from the roller 30. This pin 98 has a cam surface 100. As roller 30 passes along the arcuate portion 74 the cam surface 100 causes the rocker arm 94 to move the firing pin 92 rearwardly to a cocked position. As the cam surface on pin 98 continues to move past and thus free the rocker arm, the firing spring 90 causes the firing pin 92 to move forwardly and fire the weapon. The firing pin spring 90 provides a constant forward force and enables the firing pin 92 to strike all cartridges at the same velocity.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. An externally powered carrier for an automatic firing weapon comprising:

a carrier with bolt adapted for longitudinal movement within the weapon receiver, said carrier having a laterally extending cam track, a shaft, means for rotating said shaft, an eccentrically positioned pin, crank means on said shaft rotatably driven by and about said shaft, said pin being mounted on said crank means spaced from and parallel to the axis of said shaft to thus generate a circle with the axis of said shaft at the center thereof, said pin being positioned within said cam track for movement therealong, whereby rotation of said shaft causes circular movement of said pin about said shaft and longitudinal movement of said carrier.

2. An externally powered carrier for an automatic weapon as in claim 1 wherein said cam track is straight and said bolt is of the self locking type.

3. An externally powered carrier for an automatic weapon as in claim 1 wherein said pin has a roller connection with said cam track.

4. An externally powered carrier for an automatic weapon as in claim 1 wherein said cam track has an arcuate portion to provide a forward dwell time for said carrier while said shaft and pin continue rotation.

5. An externally powered carrier for an automatic weapon as in claim 1 wherein said crank means is a crank disk on said shaft with a vertically oriented spiral cam slot therein, a locking lug vertically moveable in the receiver of said weapon for engagement with said carrier when said carrier is in forward battery position, said locking lug having means thereon engageable with said spiral cam slot on said crank disk for removing said locking lug from engagement with said carrier to permit carrier rearward movement as said crank disk continues to rotate.

6. An externally powered carrier for an automatic weapon as in claim 5, said laterally extending cam track being of such length and the pin circumscribing a circle around said shaft axis being of such radius that continued rotation of said crank disk rotates said pin thereon forwardly, said pin in said cam track on said carrier thus moving said carrier forward to battery position and reengagement of said locking lug with said carrier.

7. An externally powered carrier for an automatic weapon as in claim 1 wherein an actuator is pivotally mounted on said carrier and engageable with the firing pin of said weapon, said actuator having a projection in the path of movement of said pin whereby passage of said pin causes pivotal movement of said actuator and actuation of said firing pin.

8. An externally powered carrier for an automatic weapon as in claim 7 wherein said pin has a cam surface, said actuator is a rocker arm and said firing pin is of the striker type.

9. An externally powered carrier for an automatic weapon as in claim 7 wherein said pin has a cam surface for pivoting said actuator, said firing pin being spring urged forwardly, said actuator moving said firing pin rearwardly when pivoted by said cam surface.

* * * * *